United States Patent [19]

Chaffey et al.

[11] Patent Number: 4,836,400

[45] Date of Patent: Jun. 6, 1989

[54] CAULKING METHOD FOR FORMING A LEAK FREE CUP

[76] Inventors: Wayne P. Chaffey, 8710 Royal Ridge, Fort Smith, Ark. 72903; Joseph J. Vaxmonsky, 1245 41st Ave., Vero Beach, Fla. 32960; David L. Wagner, 1384 Inverness La., Neenah, Wis. 54956; Warren G. Wiedmeyer, 5223 Hwy. 150, Larsen, Wis. 54947

[21] Appl. No.: 193,796

[22] Filed: May 13, 1988

[51] Int. Cl.[4] ..... B65B 53/06

[52] U.S. Cl. ..... 220/81 R; 220/67; 220/76; 229/1.5 B

[58] Field of Search ..... 220/67, 76, 77, 81; 229/1.5 B

[56] References Cited

U.S. PATENT DOCUMENTS

| | | | |
|---|---|---|---|
| 2,917,215 | 12/1959 | Psaty et al. . | |
| 3,268,143 | 8/1966 | Bolcato . | |
| 3,419,183 | 12/1968 | Khoury . | |
| 3,423,823 | 1/1984 | Franek et al. | 220/77 |
| 3,760,750 | 9/1973 | Rentmeester . | |
| 4,010,703 | 3/1977 | Spiebermann, III et al. | 220/77 X |
| 4,168,676 | 9/1979 | Itoh . | |
| 4,211,339 | 7/1980 | Itoh . | |
| 4,692,132 | 9/1987 | Shushima et al. | 220/67 X |

*Primary Examiner*—John Fox

*Attorney, Agent, or Firm*—Sixbey, Friedman, Leedom & Ferguson

[57] ABSTRACT

A method for forming a leak free container, such as a paper cup, including a sidwall having a lap joint and a bottom wall connected to the sidewall by means of a bottom wall lap joint incorporating a portion of the sidewall lap joint wherein the method includes the step of applying caulking material, at a predetermined location, to one of the blanks forming the bottom and sidewall which location is selected to insure sealing of any void volume formed adjacent the sidewall lap joint within the bottom wall lap joint. Preferably, the caulking material will be a hot melt adhesive and will be employed in a cup making process involving the use of polyethylene coated paper stock. Careful control of the temperature, amount, location and viscosity of the hot melt during the lap joint forming process and of the heat and temperature used in the lap joint forming steps insure that the hot melt material ends up residing in precisely the appropriate location within the void volume. Also disclosed are a variety of cup designs in which the void volume is reliably caulked by means of the disclosed method. In the preferred design, the caulking material is placed exclusively in the exterior leg of a U-shaped void volume.

21 Claims, 3 Drawing Sheets

CAULKING METHOD FOR FORMING A LEAK FREE CUP

DESCRIPTION

1. Technical Field

The present invention relates to a method for caulking the potential leak path formed inherently in containers, such as disposable paper cups, made from two blanks having intersecting lap joints and to the container resulting from the method.

2. Background of the Invention

Achieving an inexpensive, but reliable, leak free liquid container design employing inexpensive stock material, such as paper stock, has long been an industry objective. Numerous advances have been made toward this objective involving the use of caulking in association with the lap joints of containers made from multiple blanks. For example, the patents to Itoh (U.S. Pat. Nos. 4,168,676, and 4,211,339) disclose the concept of applying a resin material to selected areas of a paper cup formed from a sidewall blank and a bottom blank wherein the resin material is deposited at the sidewall lap joint and the lap joint between the bottom and the sidewall after the cup joints are formed. While effective for the purposes disclosed, this concept is primarily designed to address the problem involved in "wicking" of liquid through the exposed edges of the paper stock. An alternative to solving this problem is to provide an anti-wicking agent in the paper stock, thereby eliminating the need for distributing resinous materials along the entire sidewall lap joint as shown in the Itoh patent.

Even if leakage through wicking is eliminated, leaks m ay still develop in conventional type containers, such as cups, formed from a sidewall blank and a bottom wall blank in the joint area between the bottom wall and sidewall. Again, caulking of this area has been suggested as disclosed in Bolcato (U.S. Pat. No. 3,268,143) which discloses the concept of applying caulking to the exterior of the joint area between the bottom wall and sidewall of a drinking cup. As in the case of the Itoh disclosures, the caulking material is applied after the cup blanks are joined. Moreover, the caulking is on the exterior side of the cup. Therefore, hydrostatic pressure would tend to dislodge the caulking material and increase the likelihood of failure in the caulking seal. Other examples of caulking material used in liquid containers is disclosed by Khoury (U.S. Pat. No. 3,419,813) which discloses a thermoplastic adhesive and Psatz et al (U.S. Pat. No. 2,917,215) which discloses the use of a thermoplastic caulking compound generally in the area of the bottom wall to sidewall lap joint.

Outside of the cup forming art, it has been known to apply a meltable side seam material to one edge of a sidewall forming blank prior to the blank being formed into a tubular body for a liquid container as illustrated in U.S. Pat. No. 3,760,750 to Rentmeester.

A well known method for forming an inexpensive liquid container such as a disposable drinking cup is to form the container from a sidewall blank and a bottom wall blank by bending the sidewall blank into a tubular configuration and joining together the opposed edges in a sidewall overlap joint followed by joinder of the sidewall and bottom wall along a bottom wall lap joint incorporating a portion of the sidewall lap joint. Inherently, this type of design causes a potential path for liquid to leak from the interior of the container along a void volume formed adjacent the portion of the sidewall lap joint which is incorporated into the bottom wall lap joint. Various techniques have been developed to reduce the leak potential this void volume such as additional heat and pressure at the volume location or shaving of a chamfer on the inner edge of the sidewall lap joint. While these techniques are effective to some degree, they can not completely eliminate the void volume and the resulting possibility of a leak therethrough.

SUMMARY OF THE INVENTION

It is an object of the present invention to provide an effective and inexpensive method for reducing the opportunity for a leak to form in the lap joint of a liquid container.

A more specific object of the subject invention is to provide a method for reducing the possibility of a leak forming in a liquid container made from a sidewall blank and bottom wall blank wherein the sidewall is formed into a tubular configuration by joining opposed ends along a sidewall lap joint and the bottom wall is joined to the sidewall along a bottom wall lap joint incorporating a portion of the sidewall lap joint and wherein caulking material is applied to one of the blanks prior to formation of the bottom wall lap joint.

A still further object of the subject invention is to provide a method for forming a liquid container, such as a frusto-conically shaped disposable paper cup, having a sidewall lap joint and a bottom wall lap joint incorporating a portion of the sidewall lap joint wherein caulking material is applied to the sidewall forming blank prior to formation of the bottom wall lap joint wherein the caulking material is applied in an amount and in a location which insures that the void volume inherently formed adjacent the sidewall lap joint will be blocked and sealed.

It is a still more limited feature of the subject invention to provide a method for forming a leak free container as outlined above, wherein the caulking material is a hot melt adhesive having a know n viscosity characteristic which allows the temperature the caulking material, and the heat used in the lap joint formation to be coordinated in such a fashion that the hot melt adhesive retains sufficient viscosity during formation of the lap joints to insure that the hot melt adhesive remains in the desired location to block and seal the void volume of the liquid container.

A still more limited object of the subject invention is to provide a method for forming a leak free liquid container as outlined above wherein caulking material is applied on the interior surface of the bottom edge of the sidewall blank in an area which will extend an equal distance circumferentially ahead and behind the circumferential extremity of an inner sidewall edge when the sidewall lap joint is formed.

Yet another object of the subject invention is to provide a leak free container as outlined above including a bottom wall lap joint formed by means of a U-shaped channel formed from the bottom edge of the sidewall, adapted to receive a depending flange from the bottom wall in such as a manner as to form a U-shaped void volume and wherein the caulking material may be restricted to an area spaced from the bottom extremity of the bottom edge of the sidewall blank to thereby insure that caulking material is restricted to the exterior leg of the U-shaped void volume upon formation of the bottom wall lap joint.

The above objects, as well as other objects and advantages, are achieved in a preferred embodiment of the subject invention wherein a frusto-conical paper drinking cup is formed. In particular, the invention includes the steps of forming a frusto-conical sidewall from a sidewall blank of polyethylene coated, paper stock by bending the blank and heat activating the polyethylene so as to bond together the overlapped edges to form a sidewall lap joint. The sidewall is joined to a bottom wall whose perimeter edge has been bent into a configuration generally perpendicular to the remaining central portion of the bottom wall. Like the sidewall, the bottom wall is formed of polyethylene coated paper and is joined to the sidewall by reverse bending the bottom edge of the sidewall to form a circumferential U-shaped channel adapted to receive the depending peripheral flange of the bottom wall, thereby creating a generally U-shaped void volume adjacent to the circumferential extremity of the inner edge of the sidewall blank forming the sidewall lap joint. By carefully controlling the location and amount of caulking in the form of a hot melt adhesive applied to the sidewall blank, effective blockage and sealing of the void volume can be insured. In particular, the hot melt adhesive is applied to the interior surface of the sidewall blank within the bottom edge over an area which extends an equal distance circumferentially ahead and behind a circumferential extremity of the inner sidewall edge when the sidewall lap joint is formed. The location of the caulking material in this manner insures that the void volume will be blocked and sealed. Preferably the caulking material is located so that caulking material is restricted to the exterior leg of the U-shaped void volume with little or no caulking material residing in the interior leg of the U-shaped void volume where it might be extruded onto the surface of the cup forming equipment during the process of forming the bottom wall lap joint.

Still other and more specific objects of the present invention may be understood from a consideration of the following Brief Description of the Drawings and Best Mode for Carrying Out the Invention.

FIGS. *7a–7e* disclose various alternative arrangements for the bottom wall overlap joint used to connect the bottom wall to the sidewall of a cup made in accordance with the subject invention.

BEST MODE FOR CARRYING OUT THE INVENTION

Figure 1:
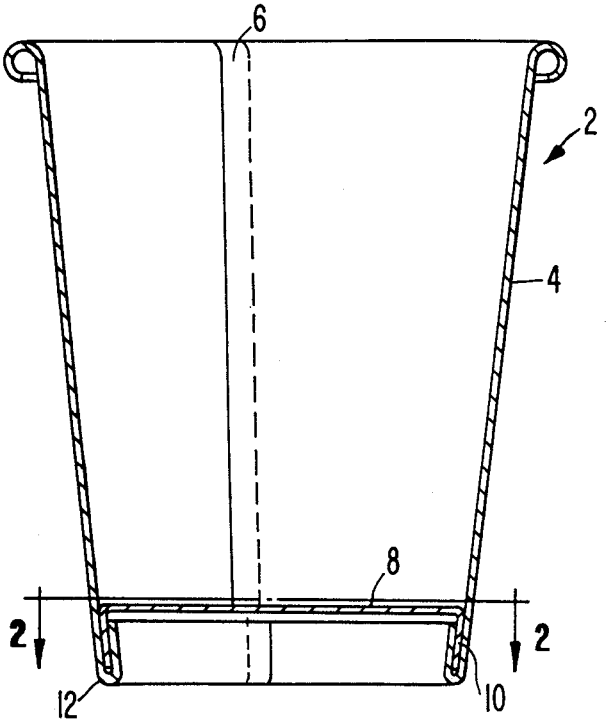
FIG. 1 is a vertical cross-sectional view of a paper cup formed in accordance with the subject invention.

FIG. 1 illustrates a typical type of leak free container in the form of a liquid cup having a generally frusto-conical configuration and formed from the joinder of a sidewall blank and bottom wall blank. Cups of this type are typically formed by bending the sidewall blank into a generally frusto-conical configuration such that opposed edges may be brought into overlapping relationship and sealed to one another in some fashion to form a liquid tight connection therebetween. Cup 2 includes such a sidewall 4 including a sidewall lap joint 6. The bottom wall 8 is joined to the sidewall by bending down the peripheral edge thereof to form a depending peripheral flange 10. The bottom edge of sidewall 4 is bent inwardly and reversely upon itself to form a U-shaped channel around the bottom circumference of sidewall 4. This channel is adapted to receive the depending peripheral flange 10 to form a bottom wall lap joint which may be sealed against liquid leakage.

In accordance with the preferred embodiment of the subject invention, the cup of FIG. 1 is formed from a paper stock blank which is coated on both sides by polyethylene. Typically the sidewall may be formed of 227 lb. per ream paper stock having a 0.010 inch thick coating of polyethylene on both sides thereof. The bottom wall may be formed of a similar type of paper stock. Alternatively, the subject invention has been successfully tested using a lower weight paper stock, 139 lb. per ream, also coated on both sides by a 0.010 inch thick layer of polyethylene. The heavier paper stock has a caliber of 0.021 inches, whereas the lighter weight paper stock has a caliber of 0.013 inches.

When using polyethylene coated paper of the type described above, the lap joints illustrated in FIG. 1 may be formed simply by application of heat and pressure sufficient to cause the polyethylene to seal together in a liquid tight manner. The paper stock itself is treated with a specially designed sizing material which prevents leakage of liquid through the cut edges exposed to liquid within the container.

The use of polyethylene coated paper stock in forming cups of the style illustrated in FIG. 1 has been found to be extremely desirable in that highly reliable leak free lap joints may be readily formed by application of heat and pressure as indicated above. However, a generally U-shaped void area is inherently formed adjacent the portion of the sidewall lap joint incorporated into the bottom wall lap joint. The primary objective of this invention is to deal with and eliminate the potential for leaks occurring in this joint as will be explained more fully hereinbelow. In particular, reference is made to FIG. 2 which shows the void volume 18 in exaggerated form adjacent the sidewall lap joint 6 which consists of an outer sidewall edge 20 joined to an inner sidewall edge 22. It is apparent that void volume 18 of varying size, depending upon the thickness of the inner sidewall edge 22, would inherently be formed adjacent the circumferential extremity of inner sidewall edge 22. This void volume would be bounded by the bottom edge 12 of sidewall 4 and the depending flange 10 of bottom wall 8. Because the bottom edge of sidewall 4 is turned inwardly and upwardly as illustrated in FIG. 1, a circumferential channel is formed as illustrated in dashed lines in FIG. 2. In vertical cross-section, the bottom edge 12 assumes a U-shaped configuration thereby causing the void volume 18 to assume a similar U-shaped configuration.

Figure 2:
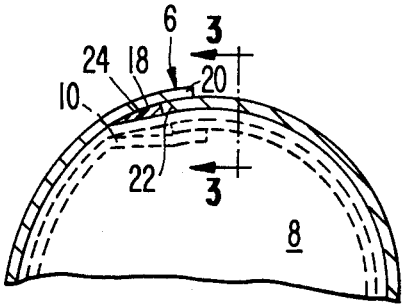
FIG. 2 is a partially broken away cross-sectional view of the drinking cup illustrated in FIG. 1, taken along lines 2—2.

As illustrated in FIG. 2, effective sealing and blocking of the void volume 18 may be achieved by placing caulking material 24 solely in the exterior leg of the U-shape void volume 18. Extending caulking material into the inner leg of the U-shaped void volume would have little effect in further reducing the potential for leakage and may result in the extrusion of caulking material, such as hot melt adhesive, onto the surface of the equipment used to form the bottom wall overlap joint. For reasons which will be explained more fully hereinbelow, the viscosity characteristics of the caulking material must be carefully considered in selecting materials suitable for implementing the subject invention. One type of commercially available caulking material found to be especially effective in implementing the subject invention is a hot melt adhesive sold by National Starch and Chemical Corporation, Finderne Avenue, Bridgewater, N.J. designated as Nat. Starch 34-2928. Other hot melt adhesives found to be effective sold are Nat. Starch 34-2931 and hot melt adhesive sold commercially under the designation of Findley 79-334.

Figure 3:
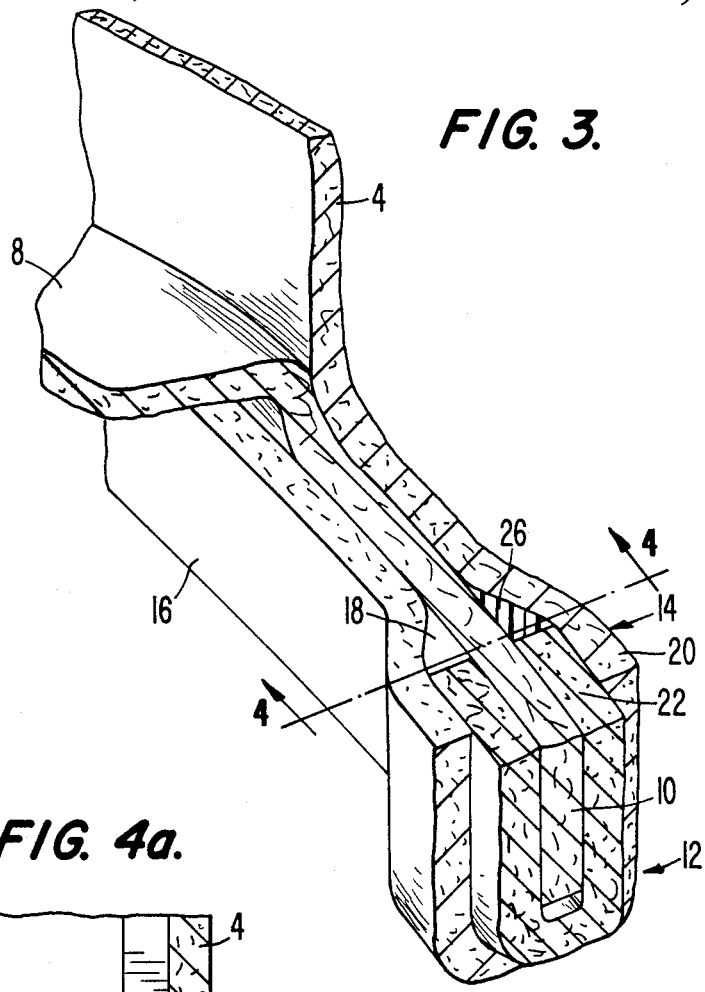
FIG. 3 is a partially broken away enlarged perspective, view of the intersection of the sidewall and bottom wall lap joints as taken along lines 3—3 of FIG. 2.

Turning now to FIG. 3, a still more graphic illustration of the void volume formed in the bottom wall lap joint is shown. In particular, FIG. 3 shows a cut-away portion of the cup illustrated in FIG. 2 adjacent to the vicinity of the void volume as contained in the bottom wall lap joint. The U-shaped void volume 18 is formed as the bottom edge 12 of the sidewall is bent inwardly and upwardly to form the U-shaped channel for capturing the downturned depending peripheral flange 10 of the bottom wall 8. As the sidewall lap joint is formed in a U-shaped configuration, inherently void volume 18 will be created having a similar generally U-shaped configuration because it will typically be impossible to apply sufficient pressure so as to close entirely the void volume 18 as shown in FIG. 3. Pursuant to an important feature of the subject invention, a caulking material, such as a hot melt adhesive, may be applied to the sidewall blank used to form the cup sidewall 4 prior to formation of the sidewall blank into its generally tubular configuration. By careful placement of the caulking material in a predetermined amount and location on the sidewall blank, it is possible to ensure that the U-shaped void volume is blocked and sealed at some point. Most desirably, the caulking material should fill at least the exterior leg of the U-shaped void volume as illustrated in FIG. 3, wherein the top surface 26 of the caulking material is shown.

Figure 4A:
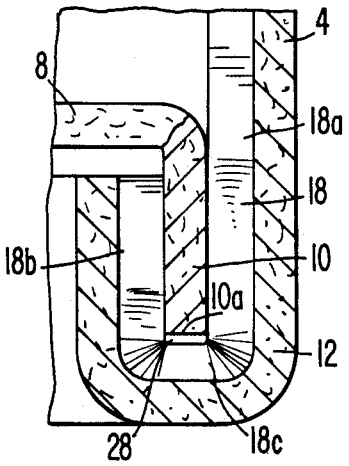
FIG. 4*a* is a broken away cross-sectional view of the void volume formed in the bottom wall overlap joint as taken along lines 4—4 of FIG. 3, wherein the caulking material is not illustrated.

Referring now to FIG. 4*a*, the U-shaped configuration of void volume 18 is illustrated still more graphically. In this view, it is apparent that void volume 18 includes an exterior leg 18*a* communicating at its upper end with the interior of the container and an interior leg 18*b* communicating at its lower end with the lower end of exterior leg 18*a* through a cross passage 18*c* and at its upper end with the exterior of the cup. In the cup forming process, it is often difficult to insure that the lower extremity 10*a* of the depending peripheral flange 10 is tightly secured to the inturned bottom edge 12 of the sidewall 4. Accordingly, an additional leak path 28 extending circumferentially from the void volume 18 may be formed. The existence of leak path 28 obviously makes far more critical the blocking and sealing of exterior leg 18*a* than is the blockage of interior leg 18*b*. Moreover, excess caulking material which finds its way into leg 18*b* will result in the possibility of extrusion through the upper end of interior leg 18*b* onto the bottom wall lap joint forming equipment which makes the cup.

Figure 4B:
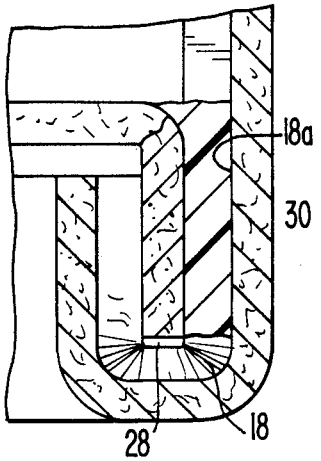
FIG. 4*b* is a cross-sectional view identical to FIG. 4*a* wherein the caulking material used in accordance with the subject invention is illustrated.

Referring now to FIG. 4*b*, the desired location for the caulking material 30 within the void volume 18 is illustrated. In particular, the caulking material 30 desirably is placed in a location and in an amount on the sidewall blank such that it substantially fills, blocks and seals the exterior leg 18*a* of the void volume. By placing the caulking compound in this location, reliable leak free cup formation can be achieved without extrusion of excess caulking material from the void volume. While a variety of cup forming processes and cup designs may profitably employ the features of the subject invention, successful operation has been achieved on paper container making equipment manufactured by Paper Machinery Corporation described in U.S. Pat. Nos. 4,490,130 and 3,745,891. In particular, cups have successfully been formed using the subject invention by using a hot melt applicator model 2302 SD, sold by Nordstrom Corporation, Union, N.J. to apply the above identified National Starch hot melt adhesive.

In cup making equipment manufactured by Paper Machinery Corporation, the bottom w all blank is subjected to a bending operation to form the depending peripheral flange and the bottom wall is mounted on a mandrel with the flange pointing away from the mandrel. Subsequently, the sidewall blank is bent around the mandrel upon which the bottom wall is supported and the sidewall lap joint is formed. Next the bottom wall is moved axially to properly position the peripheral flange of the bottom wall into engagement with the lower edge of the sidewall. Finally, the bottom edge of the sidewall is reverse folded to trap the depending flange of the bottom wall. This final step includes an internal expanding mandrel designed to press the inturned portion of the bottom edge against the interior surface of the depending peripheral flange of the bottom wall. It is this last step which could lead to extrusion of caulking compound should an excess quantity be placed on the sidewall or be improperly located.

An important feature of the cup making process implemented on the above described Paper Machinery equipment is the provision of means for heating the polyethylene coating on the paper stock blanks forming the overlapping sections of the cup lap joints. The temperatures to which these surfaces must be heated has a direct effect on the sealing performance of the polyethylene and therefore must be carefully controlled or regulated during the cup making process. Typical heater set temperatures for the Paper Machinery equipment are set forth in the following table.

TABLE 1

HEATER SET TEMPERATURES ON PMC EQUIPMENT

| HEATER LOCATION | SET TEMPERATURE °F. | AIR FLOW SETTING |
|---|---|---|
| SIDEWALL 1 LOWER | 920 | 550 |
| SIDEWALL 2 UPPER | 900 | 545 |
| BOTTOM PREHEAT | 780 | 500 |
| BOTTOM HEATER #1 | 1000 | 450 |
| BOTTOM HEATER #2 | 980 | 450 |

The Nordstrom hot melt applicator was set up to apply the hot melt at a location just after the blank exited the blanking station and as the blank was clamped by the blank grippers. Careful experimentation resulted in a determination that the ideal temperature at which the hot melt should be applied to the side wall blank was dependent upon the temperature settings of the Paper Machinery equipment while also assuring that hot melt adhesive application occurred cleanly without "stringing". The National Starch 34-2928 hot melt was run with applicator gun, hose and melt tank set at approximately 350° F. Successful operation was achieved by this technique.

An important characteristic of the hot melt employed is that it needs to remain sufficiently viscous throughout the process of application to the sidewall blank and subsequent formation of the cup lap joints to retain its location on the sidewall and thereby insure that it is properly located within the void volume at the time of bottom wall lap joint formation. Successful tests have been conducted using the National Starch hot melt 34-2928 having a viscosity of 5900 cps at 325° F. as well as a hot melt adhesive manufactured by Findley and designated 795–334, run at 325° F. with a resulting viscosity of 3200 cps. Successful operation has also been achieved by use of a hot melt adhesive designated as National Starch 34-2931 having a viscosity of 800 cps at 325° F.

Figure 5:
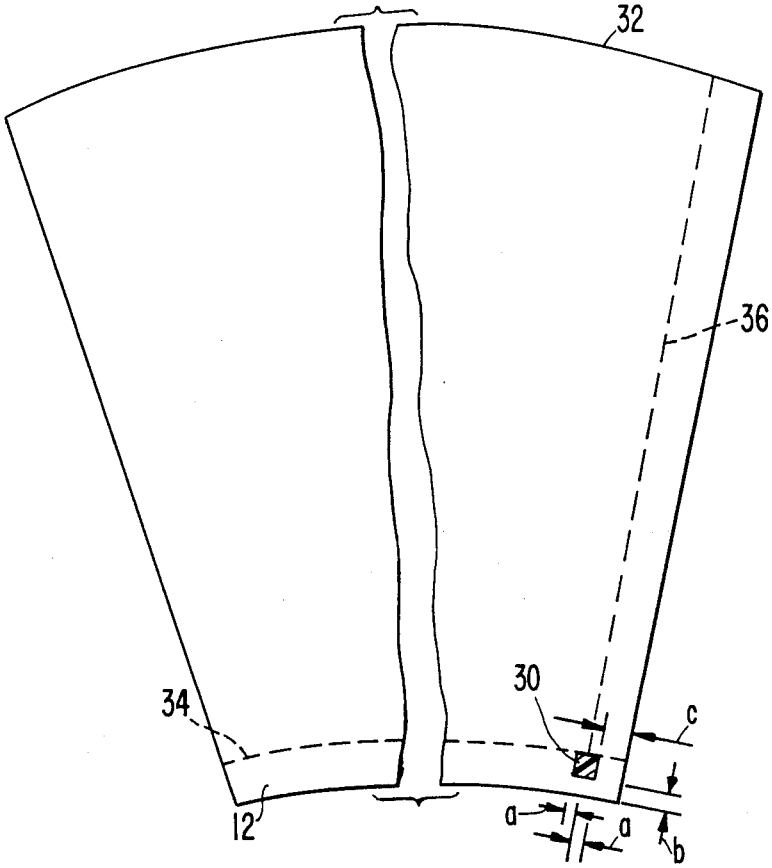
FIG. 5 is a broken away plan elevational view of a sidewall blank formed in accordance with the subject invention wherein the size and location of the caulking material is illustrated.

Referring now to FIG. 5, a plan elevational view of the sidewall blank looking at the interior surface of the blank is shown wherein the caulking material 30 is located near the bottom left hand corner spaced a distance b from the lower extremity of the bottom edge 12 of the blank 32. Distance b may typically be approximately three quarters of an inch. The upper extent of the hot melt will coincide generally with the location of the upper surface of the bottom wall when the bottom wall lap joint is formed. This location is indicated generally by dashed line 34. Distance c between the hot melt and the right hand most extremity of the sidewall blank 32 will typically be one-half to five-eights of an inch. Dashed line 36 indicates the location of the circumferential extremity of the inner sidewall edge 22 when the sidewall lap joint is formed into the configuration illustrated in FIGS. 1, 2 and 3.

The location of the circumferential extremity of the inner sidewall edge 22 is critical to the proper placement of caulking material 30 because it is the location of this extremity which defines the location of the void volume formed in the bottom wall lap joint. Desirably the caulking compound 30 is placed in an area which extends an equal distance circumferentially ahead and behind the location of the circumferential extremity of the inner sidewall edge. This equal circumferential distance is represented in FIG. 5 by the letter a which may typically be ⅛ inches. This placement insures that caulking material will completely block the void volume. To control the amount of hot melt deposited by the Nordstrom unit, dwell time is adjusted and was found desirably to be approximately 2.5 milliseconds.

Figure 6:
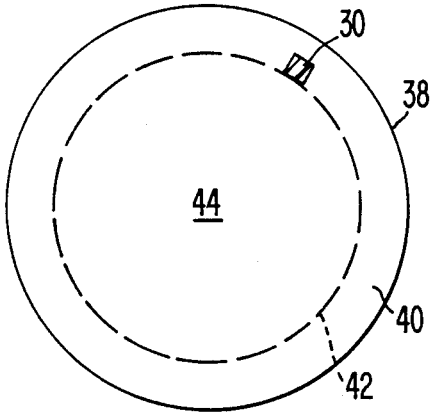
FIG. 6 is a plan elevational view of a bottom wall blank in which an alternative location for the caulking material used in accordance with the subject invention is illustrated.
Figure 7A:
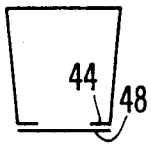
Figure 7B:
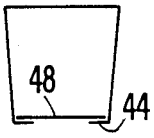
Figure 7C:
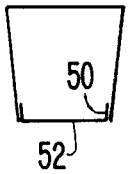
Figure 7D:
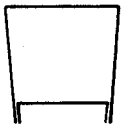
Figure 7E:
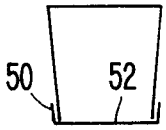

FIG. 6 illustrates an elevational view of the bottom wall blank 38 prior to the formation of the depending peripheral flange. A peripheral edge, which is bent to form the peripheral flange 10, extends radially outwardly from circular dashed line 42. Accordingly, line 42 describes the juncture point of the depending peripheral flange 10 and central portion 44 of the bottom wall. FIG. 6 shows an alternative location for the caulking compound 30. This location is less desirable because it requires careful control of the rotational orientation of the bottom wall so as to bring the caulking compound into registry with the void volume during formation of the bottom wall lap joint. Moreover, the method for forming the lap joint on the Paper Machinery equipment described above requires the conically shaped sidewall to be formed at a location which is axially displaced relative to the bottom wall. Accordingly, upon axial displacement of the bottom wall to bring the peripheral flange of the bottom wall into contact with the interior surface of the sidewall, any caulking material positioned on the bottom wall would have the tendency to be smeared over a portion of the interior surface of the sidewall. Hot melt, smeared onto the sidewall, in this manner, would be located above the upper level of the bottom wall surface and would render the cup of lesser aesthetic quality.

The subject invention has been discussed in relationship to the specific cup lap joint formation configuration illustrated in FIGS. 1–4. However, the invention disclosed herein could be applied to any type of liquid container wherein the container is formed of two blanks including a sidewall having a sidewall lap joint connected in turn to a bottom wall by means of a bottom wall lap joint incorporating a portion of the sidewall lap joint. When a container is formed in this manner, a void volume is likely to be formed adjacent the portion of the sidewall lap joint incorporated in bottom wall lap joint and the careful application of caulking compound to one or the other blank prior to formation of the bottom wall lap joint will reduce significantly the possibility of liquid leakage through the void volume. FIG. *7a* shows an alternative arrangement of the bottom wall lap joint in which the lower edge 44 of the sidewall has been bent inwardly into a plan oriented perpendicularly with respect to the central axis 46 of the sidewall. In this embodiment, the bottom wall 48 is adhered to the exterior surface of the bottom edge 44.

In FIG. *7b*, the same arrangement as shown in FIG. *7a* is illustrated except that bottom wall 48 is adhered to the interior surface of bottom edge 44 of the sidewall.

In FIG. *7c*, the peripheral flange 50 of the bottom wall 52 is oriented upwardly toward the open end of the sidewall and is adhered directly to the interior surface of the sidewall. In contrast thereto, the bottom wall 52 may be inverted and attached to the sidewall in the form illustrated in FIG. *7d*. Finally, with respect to FIG. *7e*, the bottom wall 52 has been modified slightly to cause the peripheral flange 50 to reside on the exterior of the sidewall and be joined therewith to form the bottom wall lap joint.

INDUSTRIAL APPLICABILITY

The subject invention finds particular application to the paper cup making industry where high reliability and low cost are premium considerations. The disclosed invention has particular utility in the formation of large volume containers where thicker stock material must normally be employed, thereby giving rise to a larger void volume at the intersection of the cup lap joints. Such large void volumes give rise to a higher probability of leak formation which can be readily eliminated by application of the subject invention. The disclosed invention clearly achieves the two important objectives of increased reliability while adding very little in the way of additional cost since the amount of caulking material used per cup is negligible and the added equipment cost is small.

We claim:

1. A method for forming a leak free container from a sidewall blank and a bottom wall blank, comprising the steps of (a) joining together a pair of generally opposed edges of said sidewall blank in overlapping relationship to form a sidewall lap joint including an inner sidewall edge and an outer sidewall edge, (b) joining the peripheral edge of said bottom wall to the bottom edge of said sidewall in overlapping relationship to form a bottom wall lap joint incorporating a portion of said sidewall lap joint in a manner to create a void volume bounded by said bottom wall and said sidewall adjacent the inner sidewall edge of the portion of said sidewall lap joint incorporated in said bottom wall lap joint, (c) prior to step (b), applying caulking material to at least one of said sidewall blank and said bottom wall blank at a location and in an amount which causes said caulking material to block and seal said void volume formed during step (b) to prevent said void volume from becoming a leak path for liquids placed in said container, and (d) sealing said sidewall lap joint and said bottom wall lap joint.

2. A method as defined in claim 1, wherein step (c) includes applying caulking material on the interior surface of said bottom edge of said sidewall blank in the area which will extend an equal distance circumferentially ahead and behind the circumferential extremity of said inner sidewall edge when said sidewall lap joint is formed.

3. A method as defined in claim 2, wherein step (c) further includes restricting caulking material to an area spaced from the bottom extremity of said bottom edge of said sidewall blank.

4. A method as defined in claim 1, wherein step (c) includes the step of forming said caulking material out of a hot melt adhesive.

5. A method as defined in claim 4, wherein said step (b) includes the step of forming said bottom wall lap joint by application of heat and wherein said hot melt adhesive maintains sufficiently high viscosity to avoid displacement out of its desired position during said lap joint formation steps.

6. A method as defined in claim 5, wherein said hot melt adhesive is applied at a temperature of above approximately 300° and at a viscosity of above approximately 3200 cps.

7. A method as defined in claim 1, wherein step (b) includes the steps of (i) bending the peripheral edge of said bottom wall flange to form a peripheral flange oriented at a substantially perpendicular angle to the plane of the remainder of said bottom wall blank orienting said peripheral flange to extend away from the interior of the container when joined to said bottom edge of said sidewall, (ii) joining the bottom edge of said sidewall to said peripheral flange to cause said void volume to be formed between said bottom edge and said peripheral flange, and (iii) reverse folding the bottom edge of said sidewall around the peripheral flange to trap the peripheral flange in a U-shaped channel extending around the entire circumference of the bottom edge of said sidewall, and to create a void volume having a generally U-shaped vertical cross-sectional configuration, and wherein step (c) includes the step of applying said caulking material to said sidewall blank in an amount and in a location to cause said caulking material to be located in the exterior leg of said U-shaped void volume opening into the interior of the container.

8. A method as defined in claim 7, wherein step (c) includes the step of applying said caulking material in an amount and in a location to cause said caulking material to extend up to the upper surface of said bottom wall when said bottom wall is joined to said sidewall and to cause no caulking material in said interior leg.

9. A method as defined in claim 7, wherein step (c) includes the step of applying caulking material on the interior surface of said bottom edge of said sidewall blank over an in the area which will extend an equal distance circumferentially ahead and behind the circumferential extremity of said inner sidewall edge when said sidewall lap joint is formed.

10. A method as defined in claim 9, wherein step (c) further includes restricting caulking material to an area spaced a sufficient distance from the bottom extremity of said bottom edge of said sidewall blank that virtually no caulking material is caused to reside in the interior leg of said U-shaped void volume upon formation of said bottom wall lap joint.

11. A method as defined in claim 1, wherein said sidewall blank and said bottom wall blank are formed of paper stock coated on at least one side by a layer of polyethylene and wherein said steps of forming said lap joints includes application of sufficient heat to cause said polyethylene to operate as an adhesive in forming said lap joints and wherein said caulking material is selected to retain sufficient viscosity to remain in its desired location when subjected to the heat required to activate the adhesive properties of said polyethylene.

12. A method as defined in claim 11, wherein the step of applying caulking material to said sidewall blank occurs just prior to the formation of said bottom wall lap joint whereby the heat required for forming said bottom lap joint and the viscosity characteristics of said caulking material are coordinated to insure that said caulking material remains in its desired position until the bottom lap joint is properly formed.

13. A method as defined in claim 11, wherein said caulking material is a hot melt adhesive and is applied prior to formation of said sidewall lap joint and wherein the temperature of said hot melt at the time of application to said sidewall blank and the heat applied to form said sidewall and said bottom wall joints are coordinated with the viscosity characteristics of said hot melt adhesive so as to insure that said hot melt adhesive remains in its desired location to insure that said void volume is adequately blocked and sealed to prevent leakage.

14. A container formed by the process of claim 1.

15. A container as defined in claim 14, wherein said sidewall blank and said bottom wall blank are formed of paper stock having a thickness above 0.017 inches.

16. A container as defined in claim 15, wherein said paper stock is coated on at least one side by polyethylene.

17. A container as defined by claim 14, formed as a cup wherein said sidewall has an inverted frusto-conical shape.

18. A leak free container formed from a sidewall blank and a bottom wall blank comprising (a) a sidewall of generally tubular configuration formed from said sidew all blank by joining in overlapping relationship generally opposed edges of said sidewall blank to form a sidewall lap joint, (b) a bottom wall including a peripheral edge, said bottom wall being joined to said sidewall by a bottom lap joint including said peripheral edge and the bottom edge of said sidewall and further including a portion of said sidewall lap joint in a manner to create a void volume adjacent said sidewall lap joint, said void volume being bounded by said peripheral edge and said sidewall bottom edge, (c) sealing means for sealing said sidewall lap joint and said bottom lap joint, and (d) caulking material blocking and sealing said void volume to prevent leakage of liquid within the interior of the container through said void volume, said caulking material being separate from said sealing means and attached to one of said sidewall blank and said bottom wall blank prior to the formation of said bottom lap joint.

19. A leak free container as defined in claim 18, wherein the bottom edge of said sidewall is bent inwardly and upwardly to form a circular U-shaped channel around the bottom edge of said sidewall, and said peripheral edge of said bottom wall being bent downwardly to form a peripheral flange oriented generally perpendicularly to the remaining central portion of said sidewall, said peripheral flange being received in said U-shaped channel and said void volume extending from the interior to the exterior of the container through said bottom lap joint along a generally U-shaped path, and said caulking material filling a substantial portion of the exterior leg of said U-shaped path.

20. A leak free container as defined in claim 18 wherein said sealing means comprises a sealant material.

21. A leak free container as defined in claim 18 wherein said sealing means comprises heating said sidewall lap joint and said bottom lap joint to a level sufficient to bond together said generally opposed edges of said sidewall blank, and said peripheral edge of said bottom wall and the bottom edge of said sidewall.

* * * * *